US012546524B2

(12) United States Patent
Page et al.

(10) Patent No.: US 12,546,524 B2
(45) Date of Patent: Feb. 10, 2026

(54) SYSTEMS AND METHODS OF ICE MAKING DEVICES

(71) Applicant: SharkNinja Operating LLC, Needham, MA (US)

(72) Inventors: Harry Oliver James Page, Reading (GB); Kristof Benedict Fogarasi, Holliston, MA (US); Pierce James Barnard, Manly (AU); Jared James Proulx, Northborough, MA (US); Jonathan James, Witney (GB)

(73) Assignee: SharkNinja Operating LLC, Needham, MA (US)

( * ) Notice: Subject to any disclaimer, the term of this patent is extended or adjusted under 35 U.S.C. 154(b) by 82 days.

(21) Appl. No.: 18/444,282

(22) Filed: Feb. 16, 2024

(65) Prior Publication Data

US 2024/0280309 A1 Aug. 22, 2024

Related U.S. Application Data

(60) Provisional application No. 63/533,229, filed on Aug. 17, 2023, provisional application No. 63/522,314, filed on Jun. 21, 2023, provisional application No. 63/485,730, filed on Feb. 17, 2023.

(51) Int. Cl.
*F25C 5/14* (2006.01)

(52) U.S. Cl.
CPC ..... *F25C 5/14* (2013.01)

(58) Field of Classification Search
CPC ..... F25C 5/14
See application file for complete search history.

(56) References Cited

U.S. PATENT DOCUMENTS

| | | | | |
|---|---|---|---|---|
| 4,433,559 | A * | 2/1984 | Spinner | F25C 1/147 100/145 |
| 5,104,007 | A * | 4/1992 | Utter | B67D 1/0857 222/242 |
| 7,661,275 | B2 | 2/2010 | Broadbent et al. | |
| 8,459,047 | B2 | 6/2013 | Hall et al. | |
| 8,484,987 | B2 | 7/2013 | Ducharme et al. | |
| 8,844,314 | B2 | 9/2014 | Bortoletto et al. | |
| 9,599,389 | B2 | 3/2017 | Bortoletto et al. | |
| 10,151,519 | B2 | 12/2018 | Little et al. | |
| 2010/0145522 | A1* | 6/2010 | Claesson | A47J 43/07 700/285 |

FOREIGN PATENT DOCUMENTS

| | | | | |
|---|---|---|---|---|
| AU | 2016202325 | A1 * | 5/2016 | |
| CN | 102405383 | A | 4/2012 | |
| CN | 106766453 | B | 11/2019 | |
| CN | 111928549 | B | 5/2022 | |
| EP | 2402968 | A1 * | 1/2012 | H01H 13/85 |
| GB | 2184822 | A * | 7/1987 | F25C 5/142 |
| KR | 910002140 | B1 * | 4/1991 | A23G 9/52 |
| WO | WO-0008396 | A1 * | 2/2000 | F25C 5/20 |

* cited by examiner

*Primary Examiner* — Emmanuel E Duke
(74) *Attorney, Agent, or Firm* — Foley & Lardner LLP

(57) ABSTRACT

An ice making appliance can process ice into output ice having a target structure. The ice making appliance includes a receiver to receive the ice, such as to receive preformed ice, a processor to process the ice into ice flakes, a vessel to receive the ice flakes, a press to compress the ice flakes into the output ice, and a motor to cause movement of the press to cause the compression of the ice flakes.

19 Claims, 14 Drawing Sheets

SYSTEMS AND METHODS OF ICE MAKING DEVICES

CROSS-REFERENCE TO RELATED APPLICATIONS

The present application claims the benefit of and priority to U.S. Provisional Application No. 63/485,730, filed Feb. 17, 2023, U.S. Provisional Application No. 63/522,314, filed Jun. 21, 2023, and U.S. Provisional Application No. 63/533,229, filed Aug. 17, 2023, the entire disclosures of which are incorporated herein by reference in their entirety.

FIELD

The present disclosure relates generally to ice making devices and, in particular, to ice making devices that can process pre-formed ice material into target ice shapes.

BACKGROUND

Ice making devices, such as ice-making appliances, can freeze water into ice, and can manipulate the ice into various useful structures, such as ice cubes. Some ice making devices can include stand-alone ice making appliances, which may be limited in the amount of ice that can be produced by operation of other components in which the devices are integrated, such as to not rely on the refrigeration system of a refrigerator and/or freezer to form the ice. However, such devices can have significant size, material, and/or power requirements.

SUMMARY

Systems and methods in accordance with the present disclosure can produce ice having useful characteristics, such as texture, density, and/or size. For example, various ice making devices described herein can process ice material (e.g., preformed ice, pre-formed ice) into ice flakes, and can compress the ice flakes into a target structure, such as a cylindrical structure having target texture, density, and/or size characteristics. For example, an ice making device can feed pre-formed ice an ice shaver portion, which can shave the pre-formed ice into smaller particles (e.g., ice flakes). The smaller particles of ice can be compressed into the target structure (e.g., nugget ice), which can be dispensed into a container. Various such systems and methods as described herein can allow for ice to be produced with useful characteristics while reducing device size, power usage, and/or material usage.

At least one aspect relates to an ice maker. The ice maker can include a processor to receive ice of a first size and process the ice to output ice of a second size less than the first size. The ice maker can include one or more chambers to receive the ice of the second size. The ice maker can include a press coupled with the processor assembly. The ice maker can include a motor to drive the press towards the one or more chambers to compress the ice of the second size in the one or more chambers into output ice.

At least one aspect relates to an ice making appliance. The ice making appliance can include a receiver to receive preformed ice. The ice making appliance can include a processor to process the preformed ice into ice flakes. The ice making appliance can include a mold defining an opening facing the receiver to receive the ice flakes from the receiver. The ice making appliance can include a ram to apply a force against the ice flakes in the mold into output ice to satisfy one or more criteria regarding at least one of a volume, a mass, a number of layers, a ratio of ice to air, or a shape of the output ice.

DETAILED DESCRIPTION

Figure 1B:
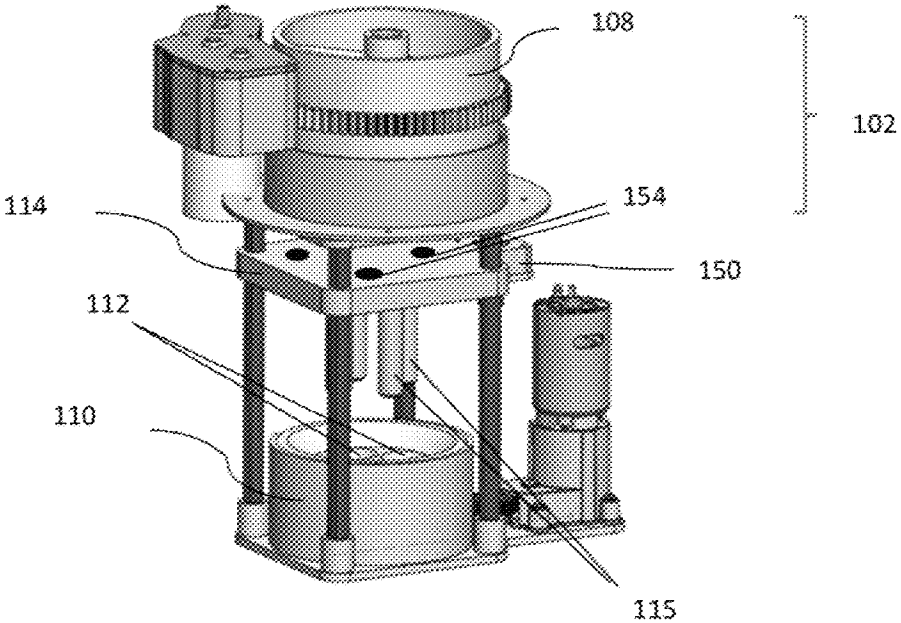
FIG. 1B depicts a perspective view of the stand-alone ice making appliance of FIG. 1A.

Following below are more detailed descriptions of various concepts related to, and implementations of, methods, apparatuses, and systems of ice making devices. The various concepts introduced above and discussed in greater detail below can be implemented in any of numerous ways.

Stand-alone ice making appliances for providing ice to consumers can be useful (e.g., compared with those incorporated into a refrigerator) because such ice making appliances do not have the same limits on the amount of ice that can be produced and do not rely on the refrigeration system of the refrigerator to form the ice. For example, it can be useful to form ice having target structural characteristics, such as ice made from layers of ice flakes compressed together. The process of forming such ice can creates pockets of air in the ice. The air pockets can make the ice softer and less dense, which can be more effectively used in blenders, among other use cases. The ice can be lighter and airier, so that it distributes more evenly in beverages than cubed ice, and can have a more pleasant texture.

Some ice making appliances form ice in an auger system, which drives water upwards through an auger casing towards an extruding head. The auger casing can be disposed within an evaporator that is connected to a cooling system. The cooling system cools the water in the auger casing and gradually forms flakes inside the auger casing, which are then scraped by the auger. This process builds the flakes up into a more viscous consistency, which the auger system compresses and then extrudes through the extruding head, forming the shape of nugget ice. Such systems can have relatively high size, weight, and/or power requirements, such as due to the manner in which the cooling system is implemented.

Ice making appliances in accordance with the present disclosure, such as standalone ice making appliances, can include a processor assembly. The processor assembly can receive pre-formed ice and can process the received pre-formed ice into smaller ice particles. A press (e.g., mechanical compressor structure, such as a compactor, plunger, ram, or piston, for example and without limitation) of the appliance can include or be coupled with a vessel for receiving the smaller ice particles from the ice processing mechanism. The press can compress the received smaller ice particles into layers of compressed ice particles, such as to output ice having one or more target characteristics resulting from the compression of the ice particles. The ice making appliance can dispense the compressed ice particles from the vessel.

In some implementations, the press can move along a plurality of pillars of the appliance via rotation of at least one leadscrew extending through the press. In some implementations, the pre-formed ice can be bullet ice. In some implementations, the smaller ice particles may be ice flakes. A direction of compression may be parallel or perpendicular to a direction of movement of the pre-formed ice through the processor assembly. The processor assembly can include a plurality of rotating blades for forming the pre-formed ice into smaller ice particles. The vessel can include a plurality of channels for receiving the smaller ice particles. The press can include a plurality of pins alignable with a corresponding one of the plurality of channels. The plurality of pins can compress the received smaller ice particles into the layers of compressed ice particles.

In various implementations, various types of pre-formed ice may be used as input material into the ice making appliances described herein, and the pre-formed ice can be broken down into types of smaller ice particles including but not limited to flakes. In some implementations, the systems and method disclosed herein can make bullet ice (e.g., to be used as the pre-formed ice, or as the ice to be outputted). The systems and methods disclosed herein can add flavor to ice during, for example, ice formation and/or during shaving of ice into ice flakes, and/or during any stage of ice formation and/or preparation. For example, adding flavor may include dispensing flavor from a flavorant container (e.g., using air pressure). In various implementations, the ice-making appliance, machine, and/or unit includes or is coupled with an electronic controller to determine one or more conditions of the unit via one or more sensors, timers, and/or switches, and in response, control one or more operations of the unit by, for example, controlling activation or deactivation of one or more motors, pumps, solenoids, presses, and/or other components used to facilitate operations of the unit.

FIGS. 1A-1E depict an example of an appliance 100 (e.g., ice-making appliance, ice maker, ice-making device, stand-alone appliance). The components as illustrated in FIGS. 1A-1E can be disposed within a housing of the appliance 100 (not shown), which can be positioned separately from other refrigeration devices in a space, such as to provide the appliance 100 as a stand-alone device.

The appliance 100 can receive and can operate on various forms of ice 106 (e.g., input ice, pre-formed ice, bullet ice). The ice 106 can be formed by another portion of the appliance 100 (not shown). The ice 106 can be cylindrical, and can have a length greater than a diameter (in some implementations, a cross-sectional area of the ice 106 varies from a first end to a second end). The ice 106 can have one or more cavities extending partially into the ice 106, such as at opposite ends of the ice 106 along a longitudinal axis (e.g., along which the length of the ice 106 is defined). As described further herein, the appliance 100 can output (e.g., into a container disposed within the housing (not shown) for consumer use), output ice having one or more target characteristics, which can be different from one or more characteristics of the ice 106.

Figure 1A:
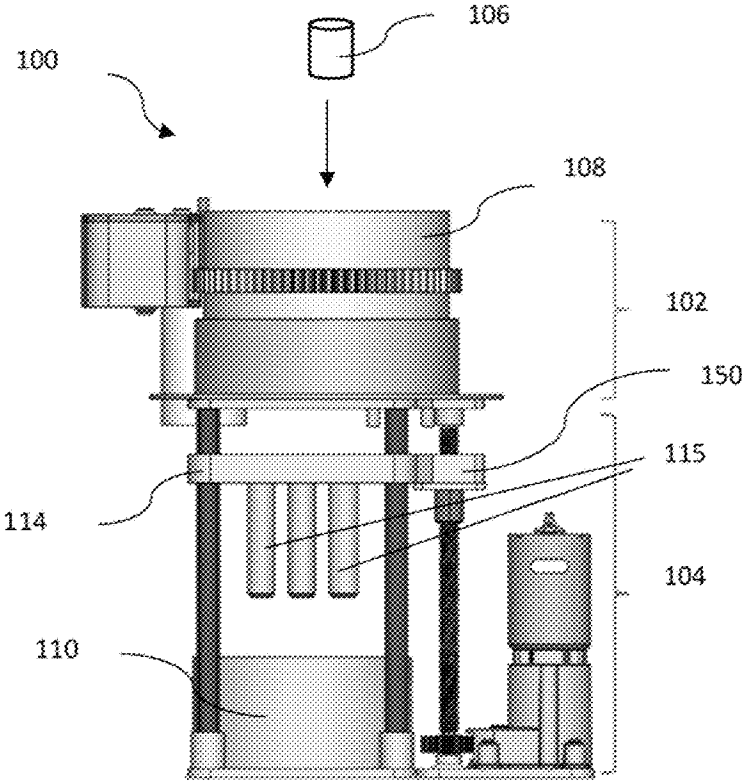
FIG. 1A depicts a front view of an example of a stand-alone ice making appliance.

As shown in FIG. 1A, the appliance 100 can include a processor assembly 102 (e.g., ice processor, ice processing mechanism; apparatus having one or more blades) and can include a press assembly 104 (e.g., ice compressor; compression mechanism). The processor assembly 102 can include at least one receiver 108 to receive the ice 106. The receiver 108 can form an opening to receive the ice 106, and can have a chamber that defines the opening to hold the ice 106. The receiver 108 can be, for example, a hopper.

The appliance 100 can drop the ice 106 into the receiver 108 of the processor assembly 102. For example, the appliance 100 can include one or more mechanically and/or electro-mechanically operated members to control the position and/or movement of the ice 106.

The appliance 100 can include at least one ice shaver, such as a single-blade or multi-blade ice shaver (not shown), which can be disposed within the receiver 108. The appliance 100 (e.g., a controller of the appliance 100) can control operation of the ice shaver to cause the ice shaver to process the ice 106 into smaller pieces of ice, such as ice flakes (e.g., such that the ice 106 has a first size (e.g., volume and/or mass) and the processor assembly 102 outputs pieces of ice, such as flakes, of a second size less than the first size). The appliance 100 can operate the ice shaver according to a schedule and/or responsive to detecting output of ice 106 and/or detecting reception of ice 106 in the receiver 108. In some implementations, the appliance 100 causes rotation of the ice shaver to cause the ice shaver to slice the ice 106.

The press assembly 104 can include at least one vessel 110 (e.g., a mold). The vessel 110 can have one or more structures having a shape corresponding to a target shape for the output ice. The vessel 110 can define an open side facing the receiver 108, such as for ice flakes outputted from the receiver 108 can be directed to the vessel 110.

The press assembly 104 can include at least one press 114. The press 114 can be or include, for example and without limitation, a ram, a compactor, a piston, a rod, a plunger, an elongated member, or various combinations thereof. The press 114 or a portion thereof can be disposed between the receiver 108 and the vessel 110.

For example, the press 114 can include a plate 150 and one or more pins 115 extending from a surface of the plate 150 toward the vessel 110. The pins 115 can be fixed to the plate 150, in some implementations. The pins 115 can extend parallel with one another. In some implementations, the ram plate 150 can have a rectangular shape, as shown, or can have circular or square shapes, for example. The pins 115 can be disposed within lateral extents of the vessel 110 (e.g., as described further herein, to allow the pins 115 to be driven towards and into a volume formed by the vessel 110).

FIG. 1B depicts a perspective view of the appliance 100 of FIG. 1A. As shown in FIG. 1B, each pin 115 can align with and extend toward a corresponding one or more channels 112 defined by the vessel 110. In examples, the plurality of pins 115 and channels 112 may be three pins 115 and channels 112, as shown; various numbers of pins 115 and channels 112 can be provided.

The processor assembly 102 can shave the bullet ice 106 into fine ice flakes, which can then pass through openings 154 defined through the plate 150 to be received in the channels 112. During the ice shaving process, the press 114 can be positioned against the underside of the receiver 108 so that the ice flakes will not become trapped on top of the press 114.

Figures 1C, 1D, 1E:
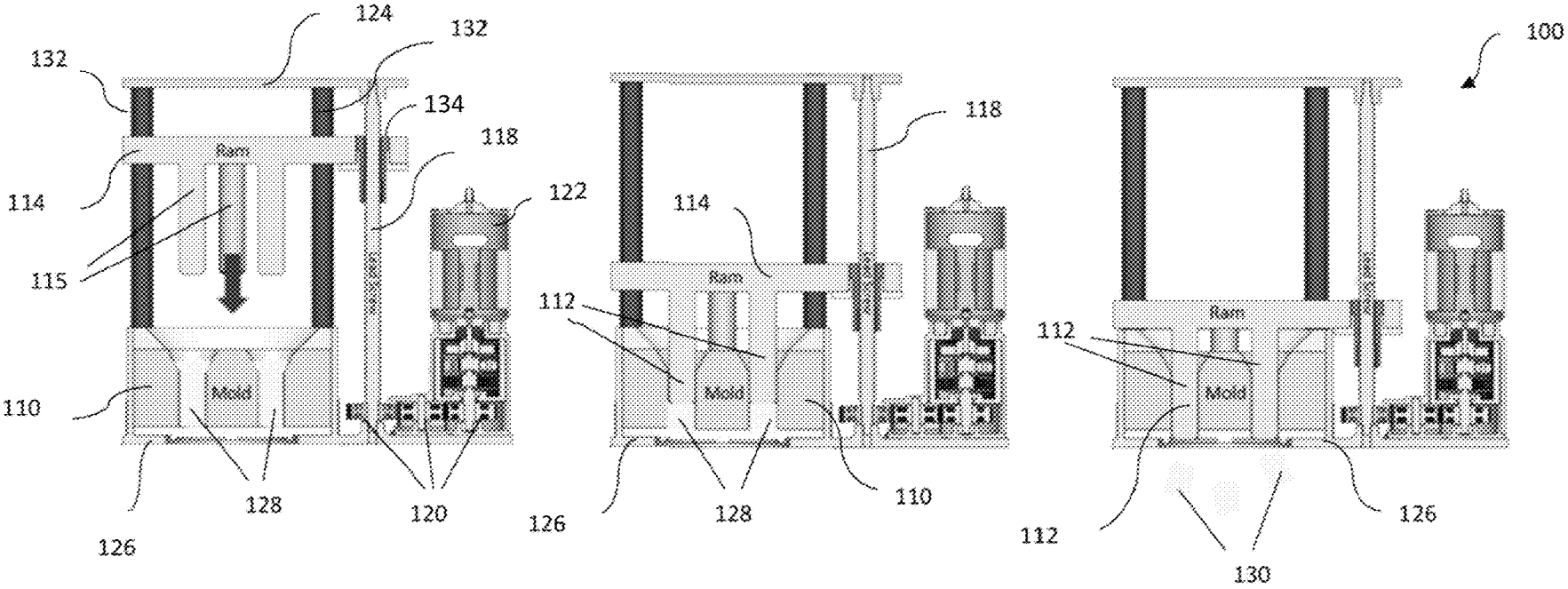
FIGS. 1C-1E depict an example of an ice compression and ejection process using the stand stand-alone ice making appliance of FIG. 1A.

FIGS. 1C-1E depict an example of the ice compression and ejection process that the appliance 100 can perform. As shown in FIG. 1C, at least a portion of the press 114 can be operatively coupled (e.g., have one or more mechanical and/or electromechanical linkages) with a leadscrew 118 extending through the portion of the press 114. The appliance 100 can include or be coupled with a motor 122, which can cause rotation of the leadscrew 118 by way of one or more gears 120. For example, as depicted in FIGS. 1C-1E, the motor 122, by way of the one or more gears 120, can have a shaft to rotate about a rotation axis and can cause rotation of the leadscrew 118 about a screw axis parallel with the rotation axis (and, in some implementations, parallel with direction of movement of the press 114, which can allow for a compact form factor for the appliance 100). For example, the motor 122 can rotate the leadscrew 118 relative to a support plate 124 and a base plate 126 of the appliance 100. In some implementations, the leadscrew 118 can have threading, and can be coupled with the press 114 by way of at least one engagement member 134 (e.g., a threaded receiver), such that rotation of the leadscrew 118 about the screw axis can cause the engagement member 134 to translate along the screw axis; the engagement member 134 can be coupled with the press 114, such as to be fixedly coupled with the press 114, to cause the press 114 to translate along the screw axis together with the engagement member 134 responsive to rotation of the leadscrew 118.

As depicted in FIGS. 1C-1E, rotation of the leadscrew 118 can cause the press 114 to move downward along a plurality of pillars 132 (which can be used to support the press 114 against lateral movement) such that the pins 115 enter the channels 112. Once inside the channels 112, the pins 115 can compress the ice flakes 128 against the base plate 126 to form output ice 130 (FIG. 1E). As such, the direction of the compression can be performed parallel to the direction of movement of the ice 106 through the hopper 508, which can facilitate efficient process flow of ice through the appliance 100 and/or allow for a compact form factor for the appliance 100. As shown in FIG. 1E, the base plate 126 can open (e.g., can have at least a portion that is pivotally or hingedly coupled with one or more other portions of the appliance 100, which can allow the ice 130 to be ejected from the channels 112).

Figure 2:
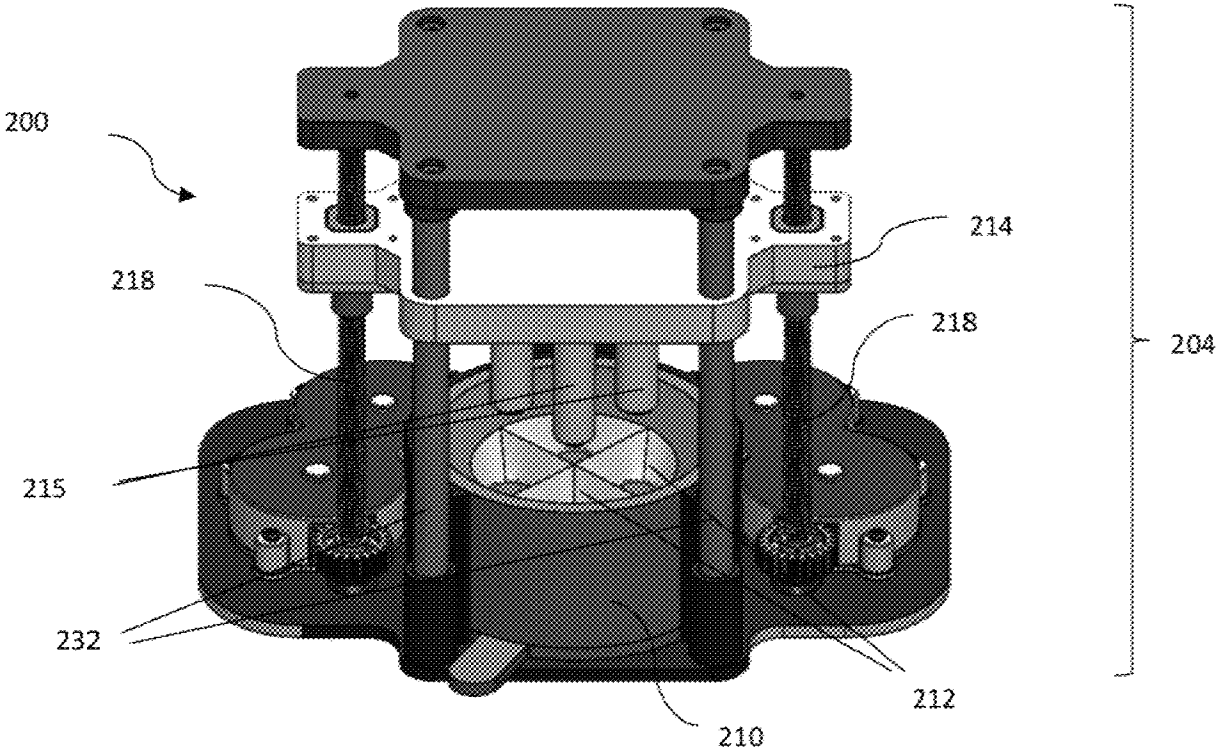
FIG. 2 depicts a partial view of an example of an ice making appliance.

FIG. 2 depicts an example of an appliance 200 (e.g., an ice making appliance and/or device, such as a standalone ice making appliance). The appliance 200 can incorporate at least some features of the appliance 100 of FIGS. 1A-1E, such as to include a press assembly 204 having a press 214 coupled with a plurality of pins 215, and a vessel 210 (e.g., mold) that can define a plurality of channels 212. The press assembly 204, for example, can include features of the press assembly 104.

The press 214 can move along a plurality of pillars 232 as a result of the rotation of a plurality of leadscrews 218, which can have threading to be rotated in opposite directions. For example, as depicted in FIG. 2, the appliance 200 can have two leadscrews 218 extending through the press 214, and which can be coupled with respective gears to be driven in opposing directions (e.g., by operation of motor 122). The use of two (or more) leadscrews 218 can reduce racking of the press 214 as it moves along the pillars 232.

Figure 3:
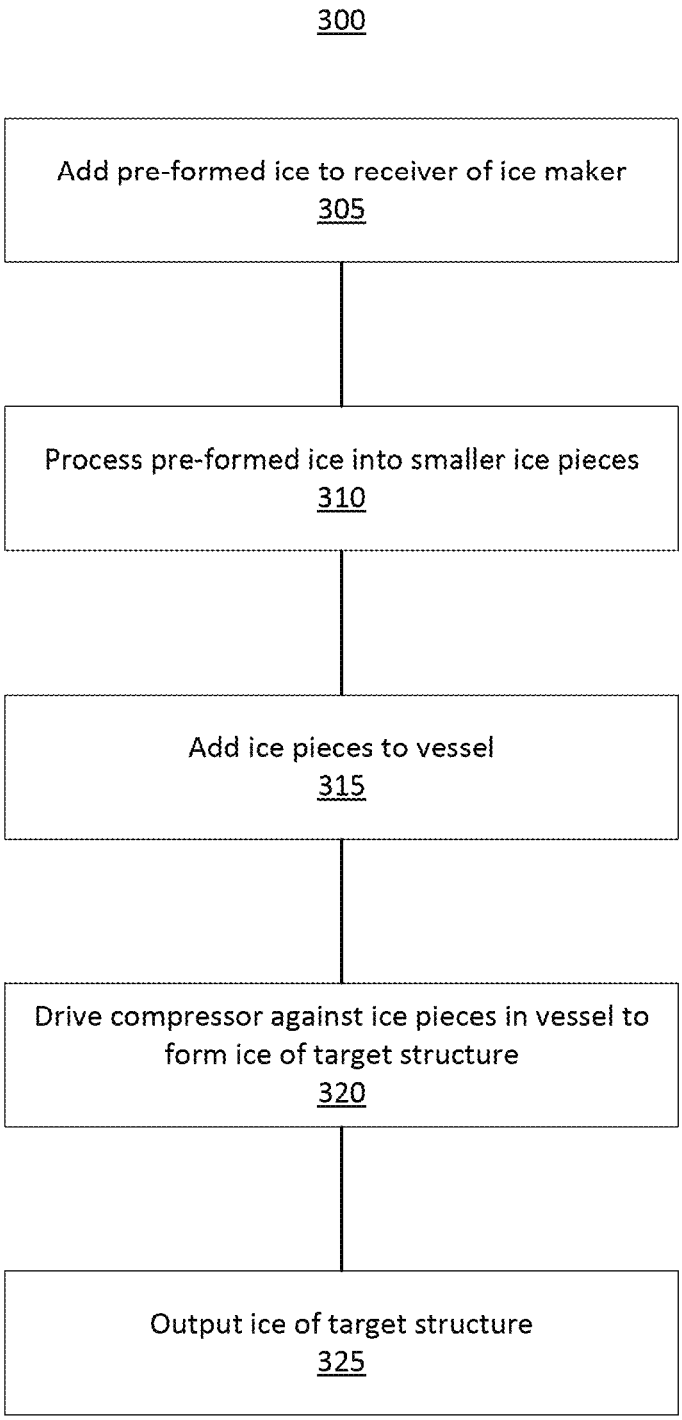
FIG. 3 depicts a flow diagram of an example of a method of making ice.

FIG. 3 is a flow chart of an example of a method 300 of making ice. The method 300 can be performed using various devices described herein, such as the appliances 100, 200, and/or 500.

The method 300 can include adding (305) (e.g., receiving) ice in a receiver of an ice maker (e.g., ice making device, ice making appliance). The ice can be pre-formed ice, such as ice have at least one of a cylindrical structure, a plurality of layers, or a plurality of air pockets. The ice can be received from an ice making structure of the ice maker, such as a structure that performs a refrigeration cycle to freeze water to form the ice. The ice can be received from a device remote from the ice maker. The ice can be received periodically, in a regular stream of ice pieces, in batches, or various combinations thereof. The ice can be received at a top side of the ice maker.

The method 300 can include processing (310) the received ice into ice pieces smaller than the received ice. For example, an ice processor such as a bladed member, a crusher, or various combinations thereof can be driven against the received ice (or can have the received ice driven against the ice processor) to cause the received ice to be changed in shape into the smaller ice pieces.

The method 300 can include adding (315) one or more ice pieces to a vessel. The ice pieces can be directed into one or more chambers (e.g., of the vessel), such as after being processed. For example, the one or more chambers can be disposed below at least one of the receiver or the ice processor, such as to allow the ice pieces to be directed at least partially by gravity into the one or more chambers. The chamber(s) can form respective molds.

The method 300 can include driving (320) a press against the ice pieces, such as to drive the press against the ice pieces in the one or more chambers. The press can include, for example, one or more pins axially aligned with the one or more chambers. An actuator, such as a motor, can cause movement of the pins (e.g., translation of the pins) towards and/or away from the one or more chambers to allow the pins to apply compressive force against the ice pieces, such as to form compressed ice pieces. The press can be driven according to one or more trigger conditions, such as detection of a threshold amount of ice pieces in the one or more chambers, a rate of receipt of ice by the ice maker, a schedule, receipt of an input (e.g., user input) requesting generation of ice, a parameter such as temperature, mass, and/or volume meeting a corresponding threshold, or various combinations thereof. The compression of the ice pieces can generate output ice, such as ice having a target structure. The target structure can include, for example, at least one of a length, width, diameter, density, void fraction (e.g., of air pockets), roughness, or number of layers of the ice.

The method 300 can include outputting (325) one or more pieces of ice of the target structure. For example, the ice can be dispensed out of the ice maker and/or into a receptacle coupled with the ice maker.

Figure 4:
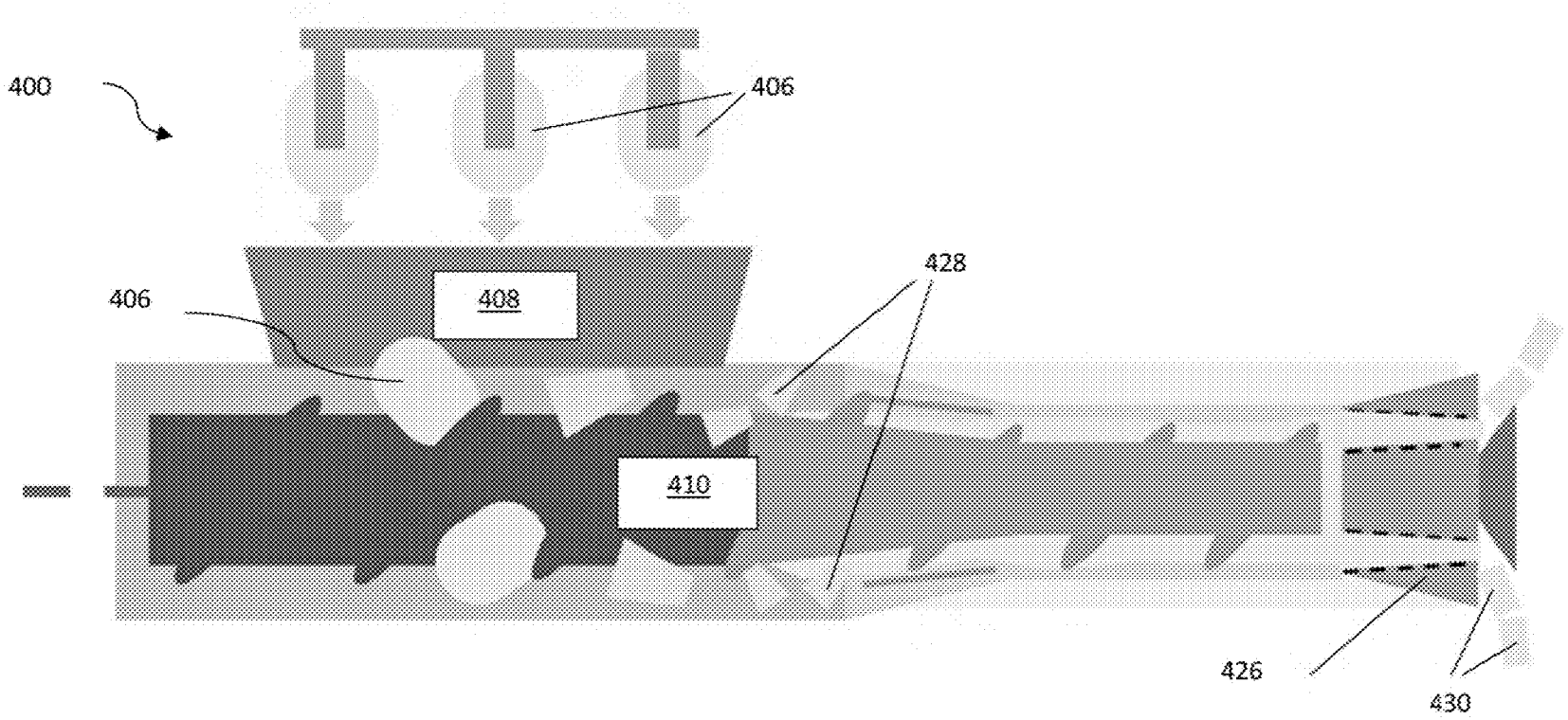
FIG. 4 depicts a schematic diagram of an example of an ice making appliance.

FIG. 4 depicts an example of an appliance 400. The appliance 400 can incorporate features of one or more systems or devices described herein, such as the appliance 100 and/or the appliance 200. The appliance 400 can implement an auger-based assembly to perform at least one of processing of ice into ice flakes and/or compression of ice flakes into ice of a target structure. For example, the appliance 400 can use the auger to generate ice of the target structure in a compact form factor (e.g., by implementing both processing and compression operations using the auger).

For example, as depicted in FIG. 4, the appliance 100 can include an auger 410 extending along an auger axis. The auger can include a plurality of auger portions, such as a first auger portion facing a receiver 408, and a second auger portion adjacent to the first auger portion along the auger axis. The auger 410 can be coupled with a drive assembly (e.g., a motor) to cause rotation of the auger 410.

The auger 410 can process (e.g., crush) ice 406 (e.g., pre-formed ice) that has been fed through the receiver 408 to form ice flakes 428, such as due to engagement of the first portion of the auger 410 with the ice 406. Rotation of the auger 410 along the auger axis (e.g., due to angled and/or helical member(s) on the external surface of the auger 410) can move the ice flakes 428 towards the second portion of the auger 410, where the auger 410 can compress the ice flakes 128 into ice 430. The ice 430 can be extruded through a die 426, such as to output the ice 430 to have the target structure.

FIGS. 5A-5I depict an example of an appliance 500. The appliance 500 can incorporate features of various devices described herein, such as the appliances 100, 200, 400. The appliance 500 can include a housing (not shown) to hold one or more components of the appliance 500 described with reference to FIGS. 5A-5E. In some implementations, the appliance 500 can be used with pre-formed ice, such as ice 506, formed by another portion of the appliance 500 (not shown). The ice formed by the appliance 500 may be further collected in a container disposed within the housing (not shown) for consumer use.

Figure 5A:
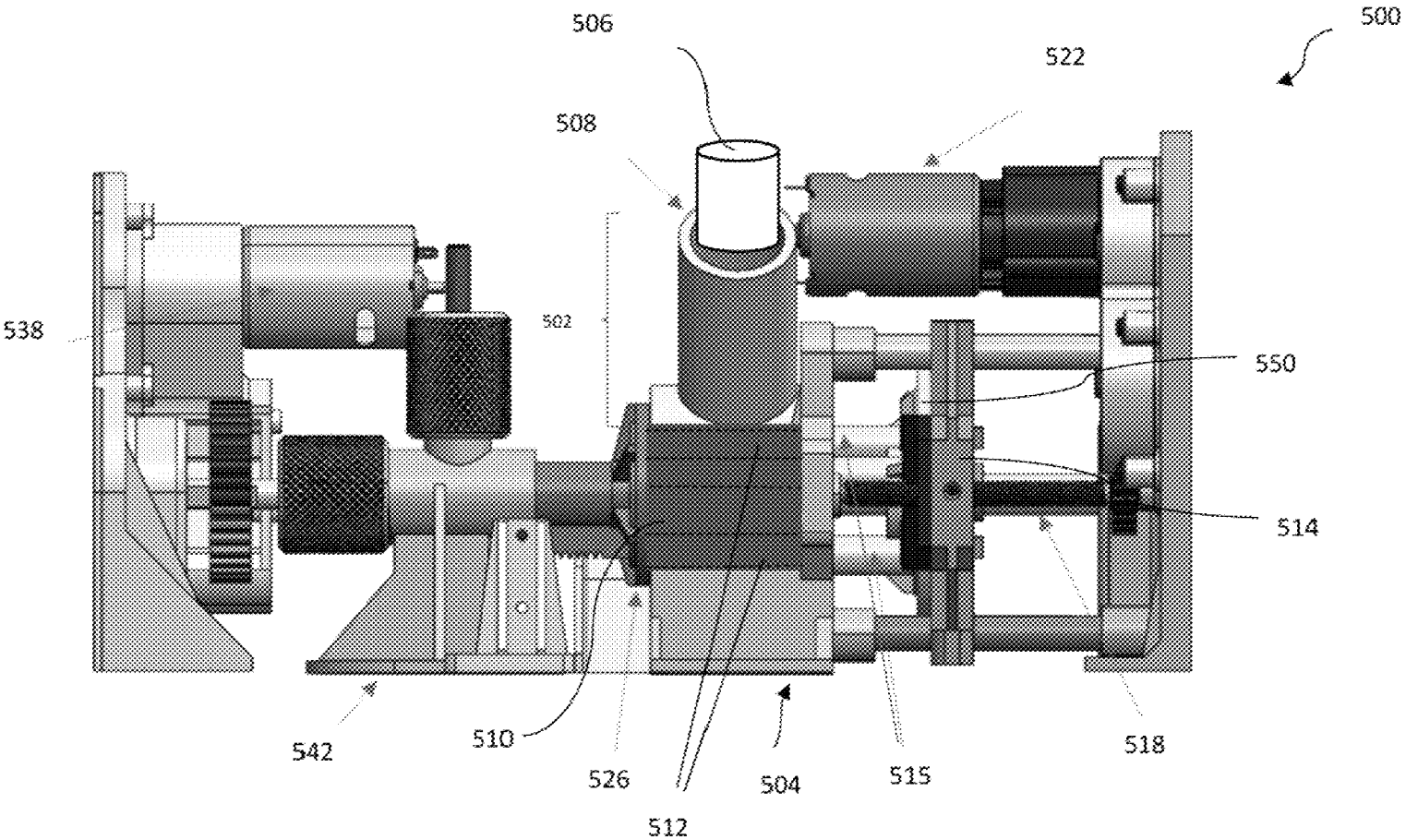
FIG. 5A depicts a partial view of an example of an ice making appliance.

FIG. 5A illustrates components of an example of the appliance 500. As shown in FIG. 5A, the appliance 500 can include a processor assembly 502 and a press assembly 504. The appliance 500 can include an ejection assembly 542, as described below.

The processor assembly 502 can include a receiver 508 (e.g., a hopper). The press assembly 504 can include a vessel 510 (e.g., mold), and can include a press 514 (e.g., ram).

The press 514 can include a plate 550. The plate 550 can be rotatable (e.g., responsive to operation of a motor), and can be coupled with one or more pins 515. For example, the one or more pins 515 can extend from a surface of the plate 550 toward the vessel 510. The plate 550 can have a circular shape, as shown, or can have rectangular or square shapes.

Each of the plurality of pins 515 can align with and extend toward a plurality of channels 512 of the vessel 510. The plurality of pins 515 and channels 512 can be three pins 515 and channels 512, or various other numbers of pins and channels. The appliance 500 can mechanically drop the ice 506 into the receiver 508 of the processor assembly 502. The ice 506 can then contact blades 534 within slots 560 (FIG. 5C) defined in an outer surface of the vessel 510. The slots 560 can be coupled with the channels 512 to fill the channels 512 with ice flakes as the blades 534 shave the bullet ice 506.

Figure 5B:
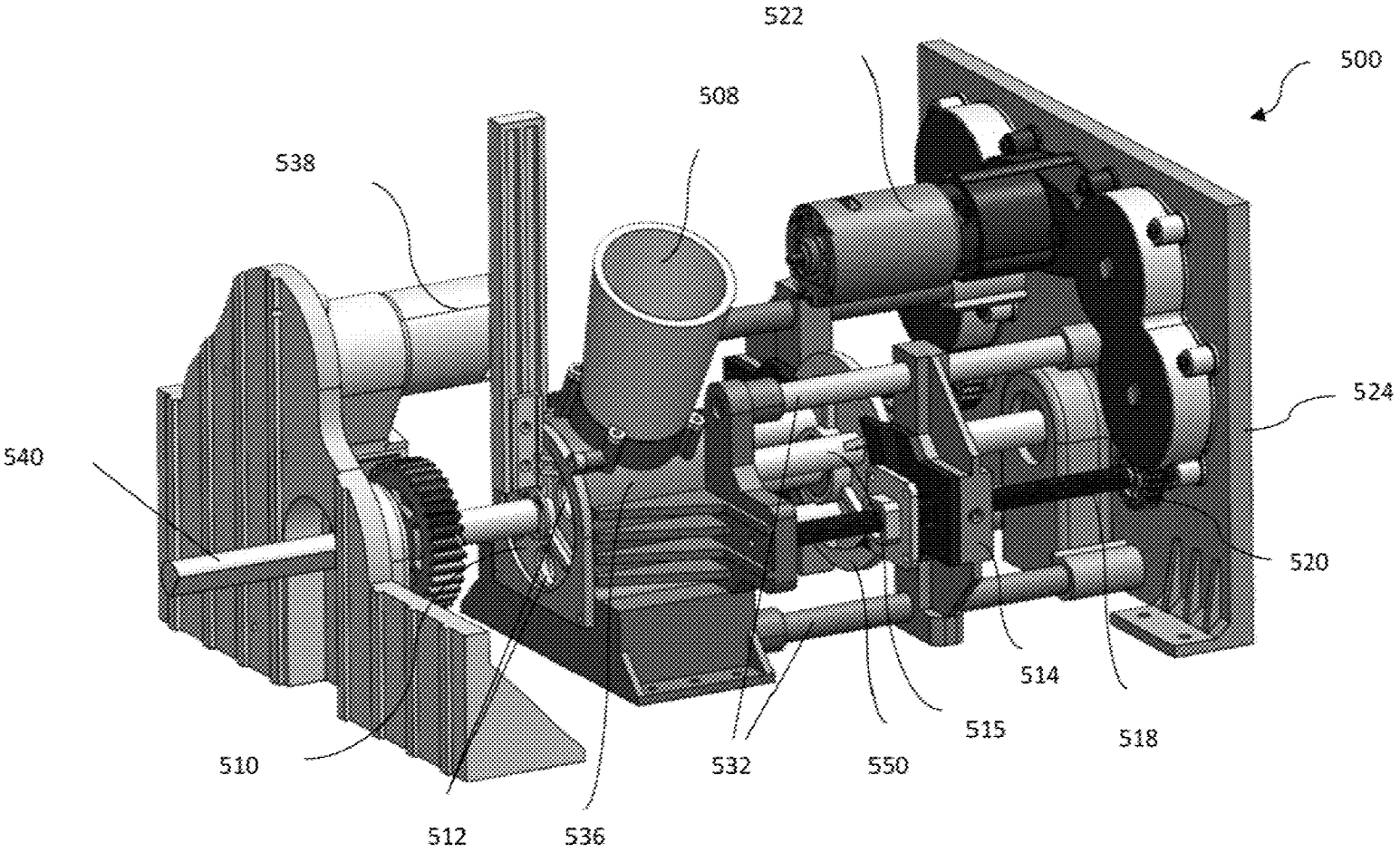
FIG. 5B depicts a perspective view of the ice making appliance of FIG. 5A.

FIG. 5B is a perspective view of the appliance 500 of FIG. 5A. As shown in FIG. 5B, a non-rotating portion of the press 514 may be operatively coupled with one or more leadscrews 518, such as opposing leadscrews 518 as depicted in FIG. 5B, that can extend through the press 514. The leadscrews 518 can be rotated responsive to operation of a first motor 522, such as by way of one or more gears 520 coupled with the first motor 522 and with the one or more leadscrews 518. The first motor 522 can rotate the leadscrews 518 relative to a support plate 524 of the appliance 500. Rotation of the leadscrews 518 can cause the press 514 to move along a plurality of pillars 532 (e.g., longitudinal members) such that the pins 515 enter the channels 512. Once inside the channels 512, the pins 515 can compress the ice flakes in the channels 512 against a base plate 526 (FIG. 5A) to form nugget ice. As such, the direction of the compression can be perpendicular to the direction of movement of the ice 506 through the hopper 508. In some implementations, the appliance 500 can include a second motor 538 operatively coupled to a rod 540 that extends through the vessel 510 and the plate 550. The rod 540 can rotate the mold 510 and the plate 550 during the ice shaving process, which can ensure that each channel 512 is filled evenly (e.g., within ten percent of equally) with ice flakes. In some implementations, a cover plate 536 can cover the slots 560 to ensure that the channels 512 fill evenly with the ice flakes during the ice shaving process.

Figure 5C:
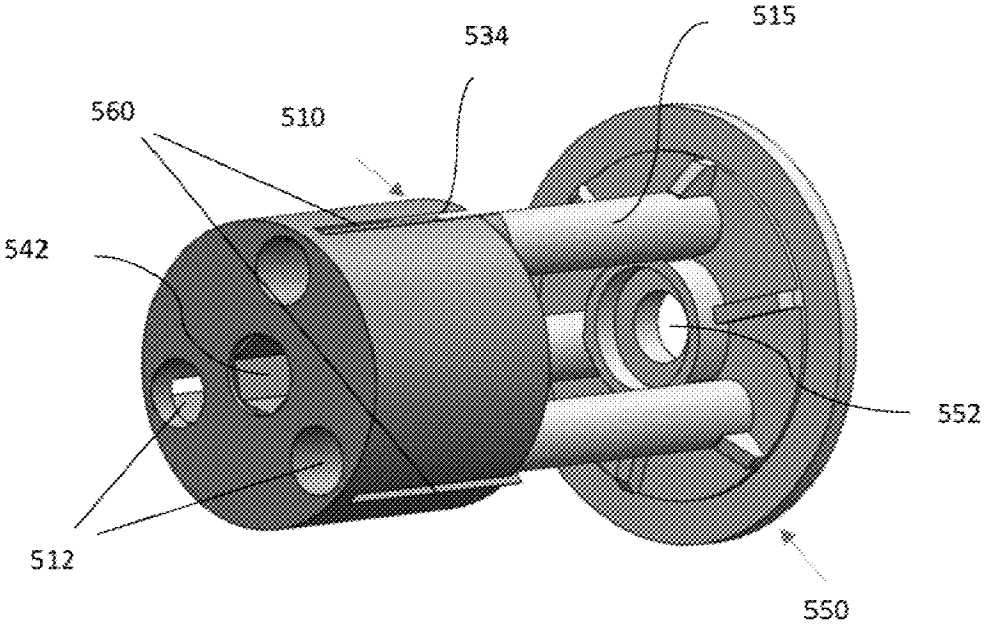
FIG. 5C depicts a detailed view of a mold and a ram of the stand-alone ice making appliance of FIG. 5A.
Figure 5D:
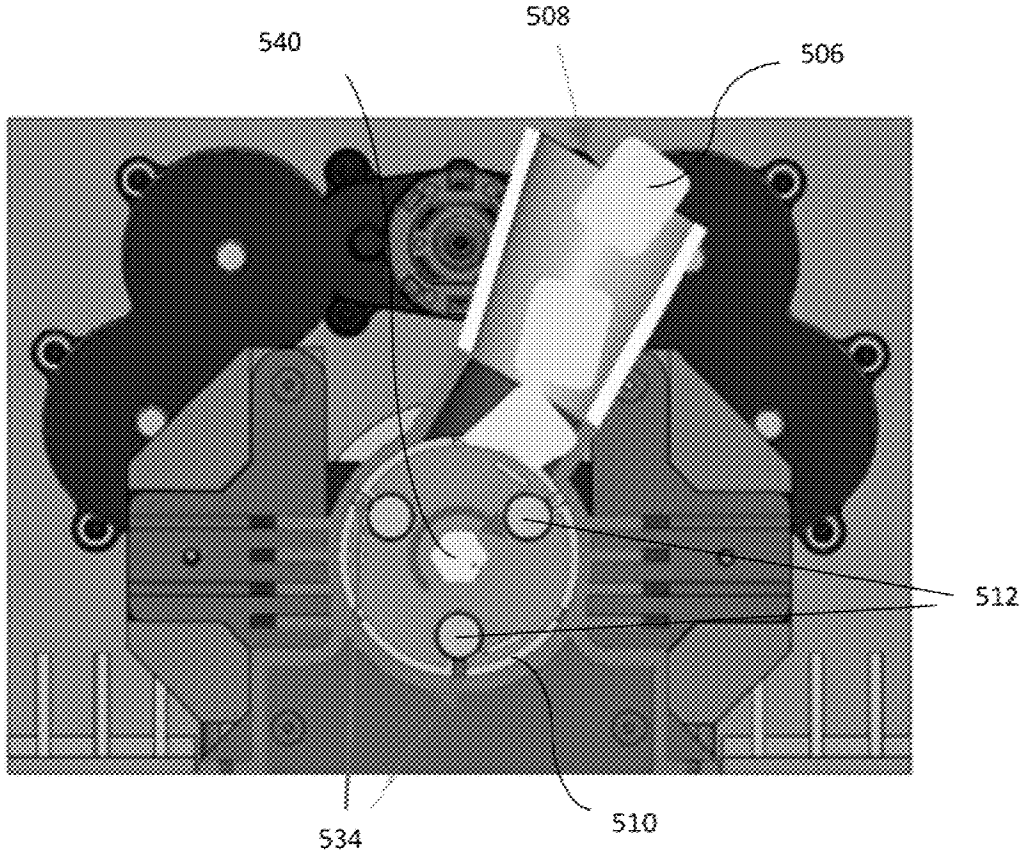
FIG. 5D depicts a cross-sectional view of a hopper, the mold, and blades of the stand-alone ice making appliance of FIG. 5A.
Figure 5E:
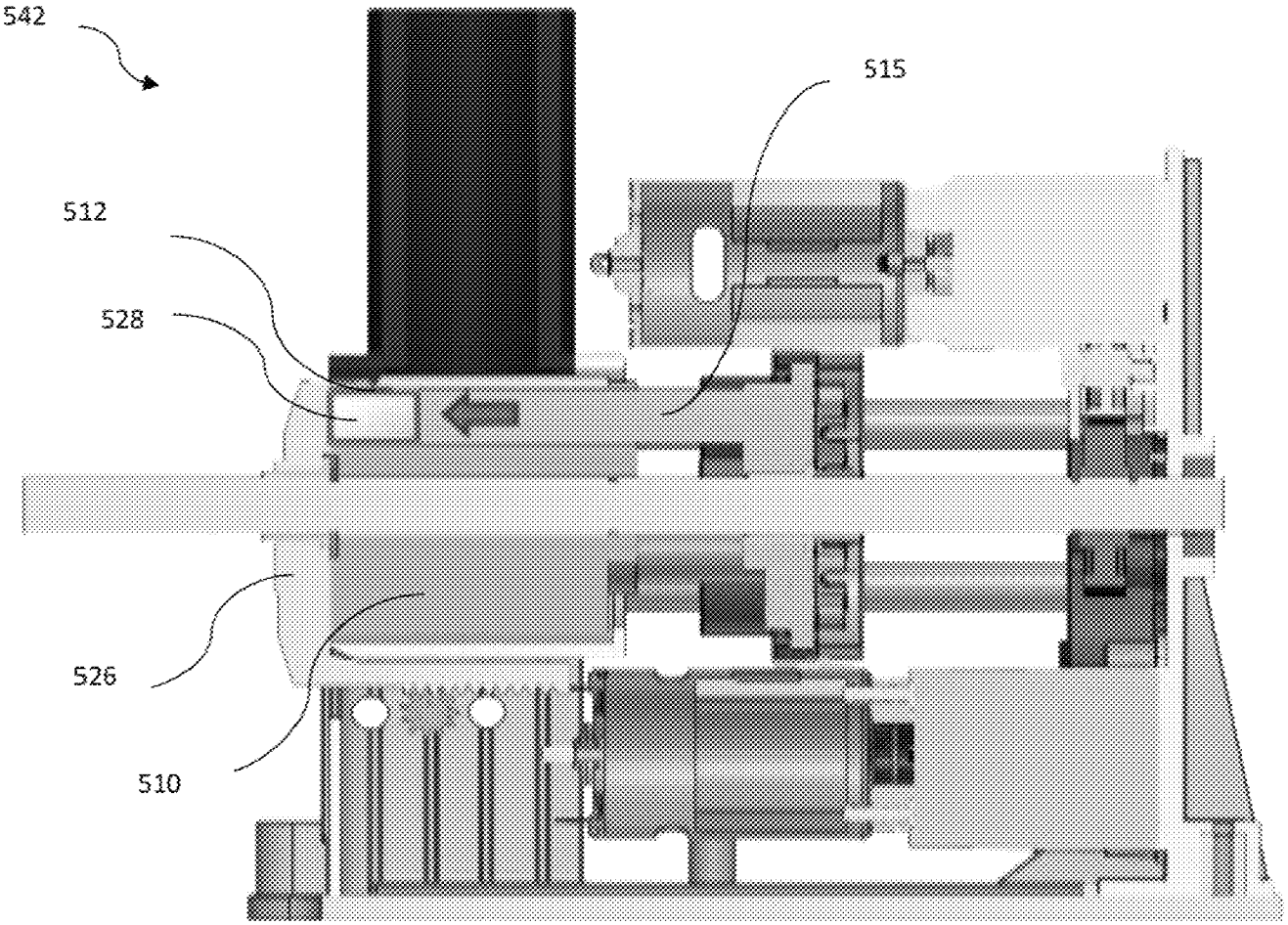
FIGS. 5E-5H depict a cross-sectional view of an example of an ejection assembly of the stand-alone ice making appliance of FIG. 5A.

FIG. 5C is a detailed illustration of an example of the vessel 510 and the plate 550. As shown in FIG. 5C, the vessel 510 can define a central channel 542 for passage of the rod 540 (FIG. 5B). The plate 550 can define a central opening 552 for passage of the rod 540. A discussed above, an outer surface of the vessel 510 can define a plurality of slots 560 in communication with the channels 512 for passage of the ice flakes into the channels 512. The blades 534 can be at least partially disposed within the slots 560 to shave the ice 506 into ice flakes for collection in the channels 512. FIG. 5D shows a cross-sectional view of an example of the hopper 508, the mold 510 and the rotating blades 534.

Figure 5F:
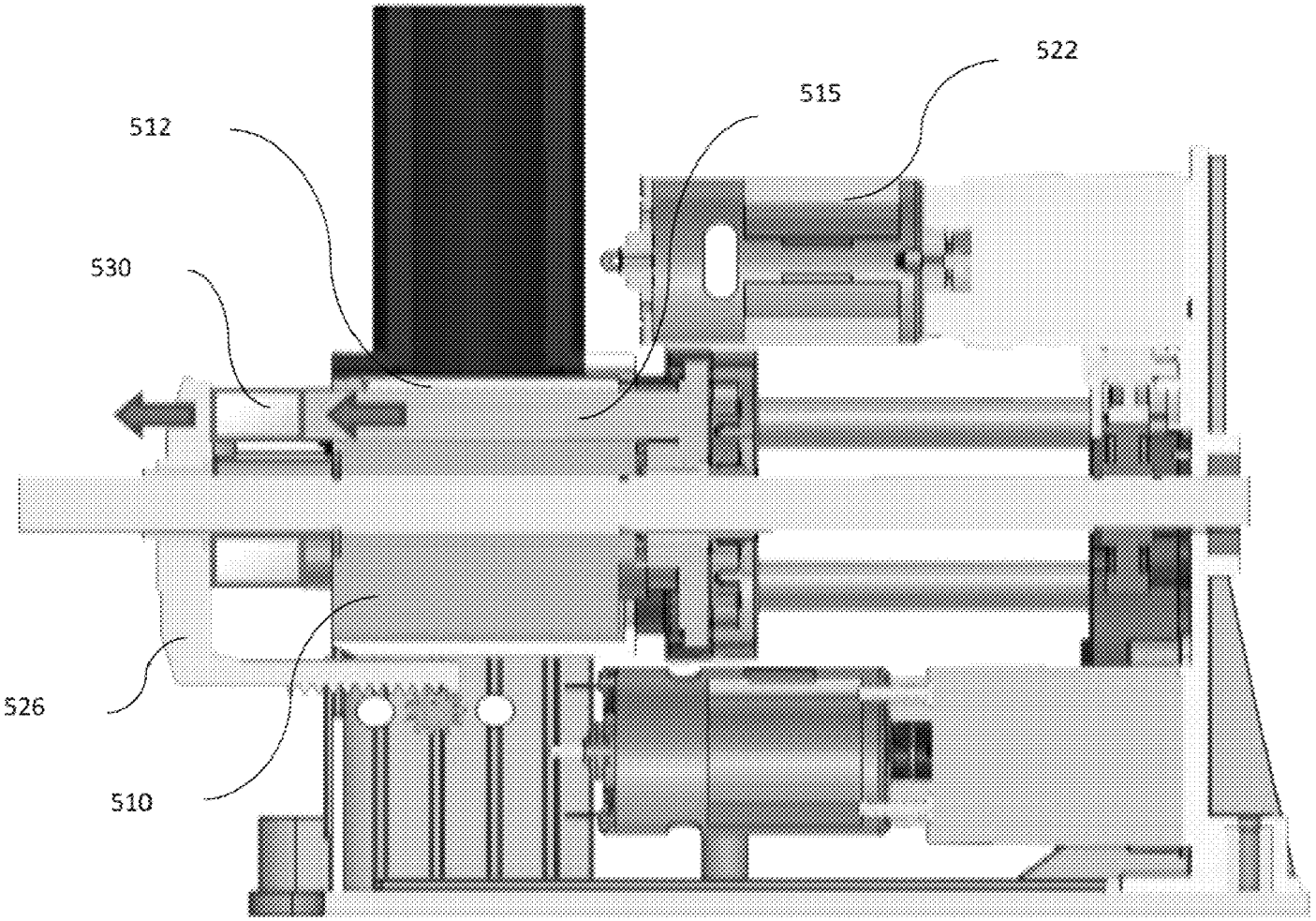
Figure 5G:
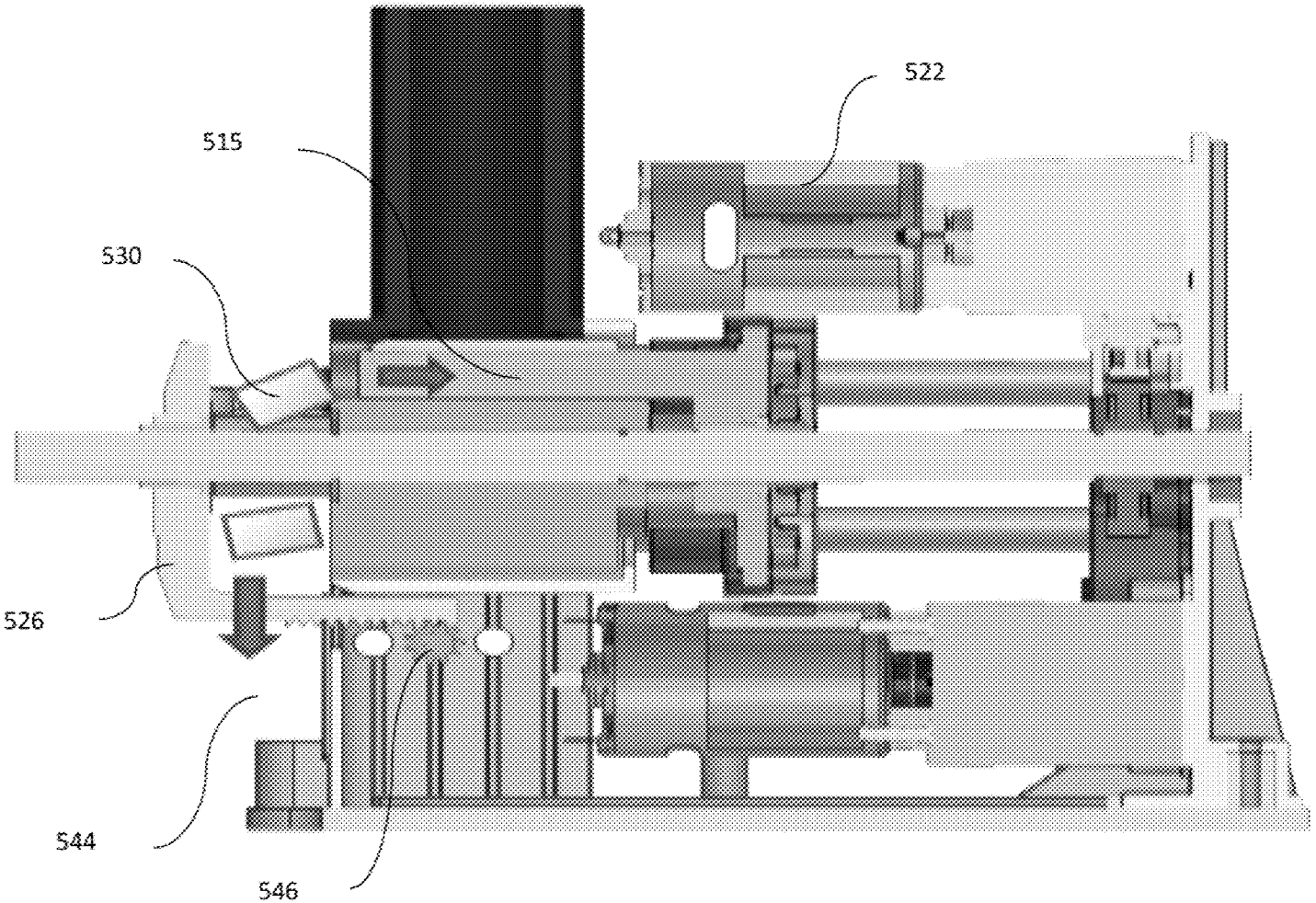
Figure 5H:
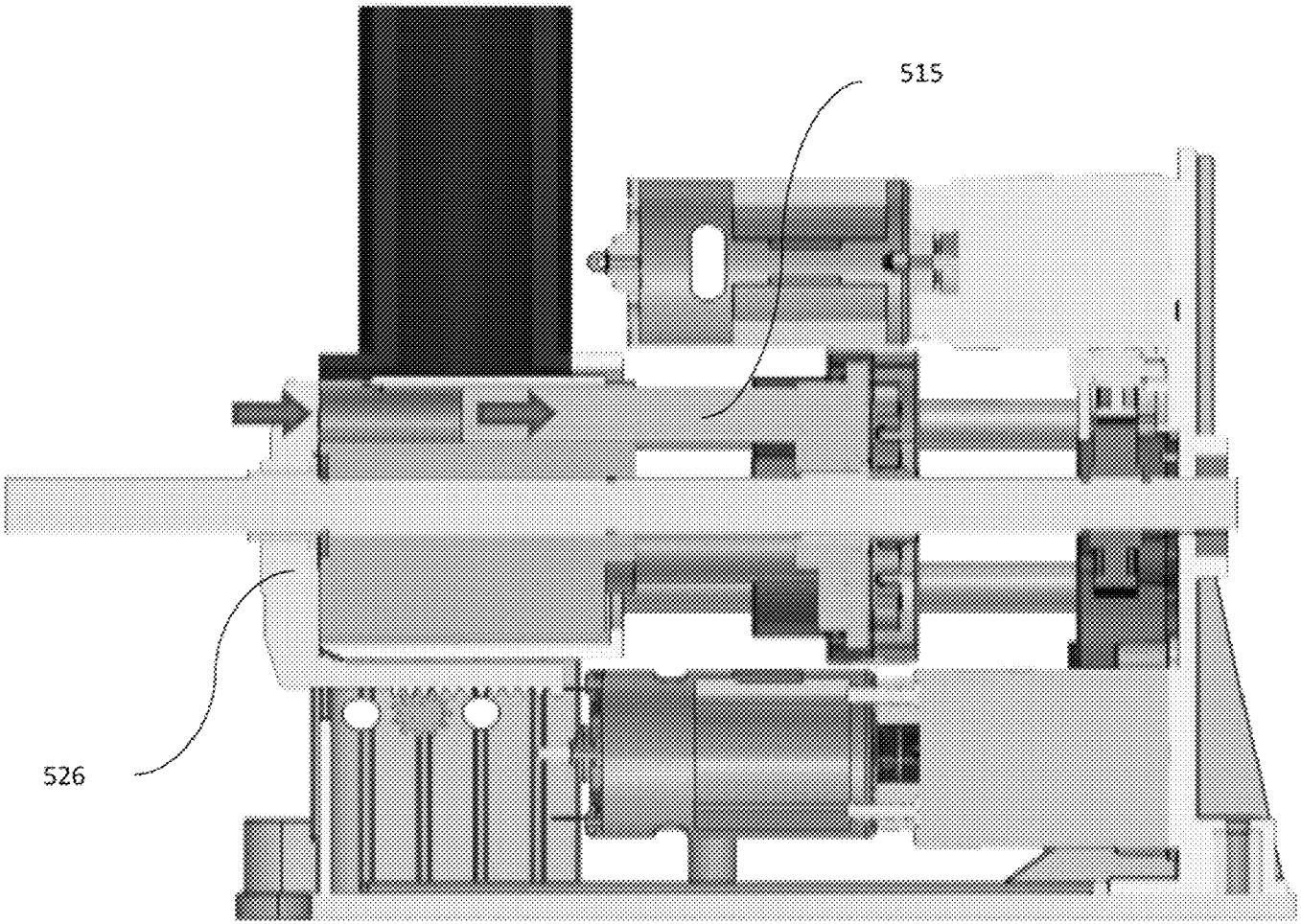
Figure 5I:
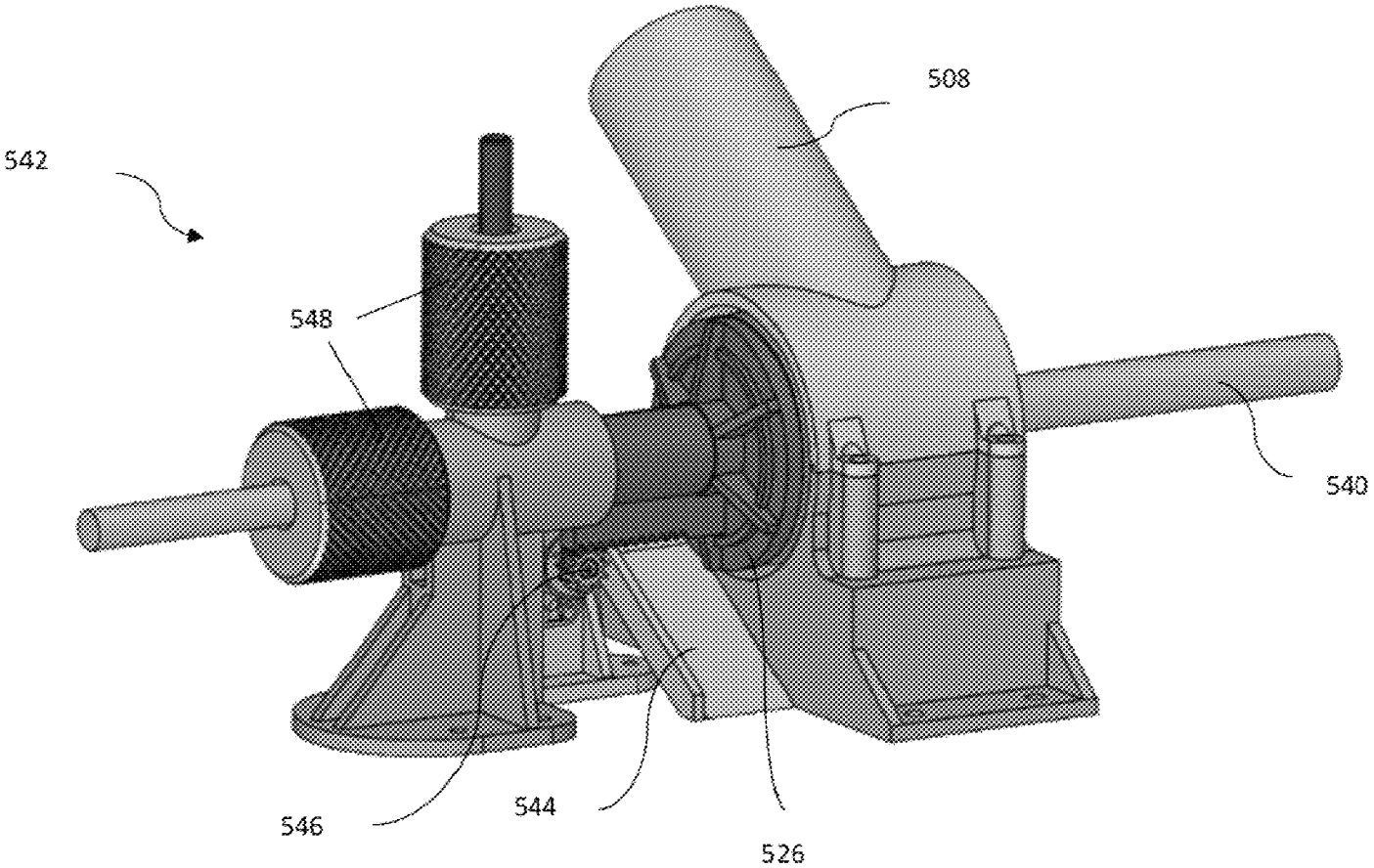
FIG. 5I depicts a perspective view of the ejection assembly of FIGS. 5E-5H.

FIGS. 5E-5H are cross-sectional views of an example of the ejection assembly 542 of the appliance 500. As show in FIG. 5E, responsive to the force of the compacted ice flakes 528 within the channels 512 against the base plate 526 meeting a threshold (e.g., a threshold such that the ice flakes can no longer be compacted and the force of the pins 515 is at least partially directed onto the base plate 526)—the base plate 526 can move away from the mold 510 (FIG. 5F). Due to adhesion forces, the base plate 526 may remain in contact with the output ice 530, suspending the output ice 530 between the pins 515 and the base plate 526. This may allow the output ice 530 to be fully driven out of the channels 512 by the pins 515. The first motor 522 can then (e.g., subsequent to receiving a second instruction) drive the pins 515 in the opposite direction (FIG. 5G), which can force the nugget ice 530 to break away from the pins 515, which can allow the nugget ice 530 to drop through a chute 544 into a container within the appliance 500. A damper 546 may limit the return travel speed of the base plate 526 to release the output ice 530. In some implementations, one or more variable force springs (not shown) may control the ejection force of the released nugget ice 530. As shown in FIG. 5H, the base plate 526 can return to position as the pins 515 retract. FIG. 5I illustrates the components of the ejection assembly 542 in a perspective view.

In various implementations, the systems and methods disclosed herein have an Ice maker working mode including one or more of: 1) a "Standby mode"; 2) an "Ice-making mode"; 3) a "Cleaning mode"; 4) "Adding water" features; and 5) an "Ice Full State." For example, one or more systems and/or devices (e.g., the appliances 100, 200, 400, and/or 500) can include or be coupled with a controller to control operation of various components, including motors, responsive to one or more of preprogrammed instructions, detection of conditions for triggering operations, and/or input instructions (e.g., user inputs). The controller can include one or more processors (e.g., hardware processors) and a memory. The processor may be a general purpose or specific purpose processor, an application specific integrated circuit (ASIC), one or more field programmable gate arrays (FPGAs), a group of processing components, or other suitable processing components. The processor may be configured to execute computer code or instructions stored in memory (e.g., fuzzy logic, etc.) or received from other computer readable media (e.g., CDROM, network storage, a remote server, etc.) to perform one or more of the processes described herein. The memory may include one or more data storage devices (e.g., memory units, memory devices, computer-readable storage media, etc.) configured to store data, computer code, executable instructions, or other forms of computer-readable information. The memory may include random access memory (RAM), read-only memory (ROM), hard drive storage, temporary storage, non-volatile memory, flash memory, optical memory, or any other suitable memory for storing software objects and/or computer instructions. The controller can be implemented as a hardware processor including a Central Processing Unit (CPU), an Application-Specific Integrated Circuit (ASIC), an Application-Specific Instruction-Set Processor (ASIP), a Graphics Processing Unit (GPU), a Physics Processing Unit (PPU), a Digital Signal Processor (DSP), a Field Programmable Gate Array (FPGA), a Programmable Logic Device (PLD), a Controller, a Microcontroller unit, a Processor, a Microprocessor, an ARM, or the like, or any combination thereof. The memory may include database components, object code components, script components, or any other type of information structure for supporting the various activities and information structures described in the present disclosure. The memory may be communicably connected to the processor via the processing circuit and may include computer code for executing (e.g., by processor) one or more of the processes described herein. The memory can include various modules (e.g., circuits, engines) for completing processes described herein. The controller can include and/or be coupled with one or more user interface devices and/or one or more network interface devices, such as to facilitate receiving or providing inputs and outputs for the controller. The controller (e.g., stored in memory) can include any one or more instructions, functions, algorithms, machine learning models, logic, rules, heuristics, or various combinations thereof to implement operations described herein.

Unit Plug-In & Standby Mode—In Some Implementations:

1. When the unit is plugged into a power supply, the buzzer of the unit will beep for one time. And all indicator lights on UI panel will light up for 1 second, indicating that the unit is connected to the power supply. After that the cleaning light, adding water light, and ice bin indicator light will turn off, then the power light and ice making light flash (0.5 s on, 0.5 s off) to enter standby mode;
2. The ice making unit includes a controller configured to control various components such as motors, the press, pumps, and other components associated with operations of the ice maker unit. The controller may also interface with one or more sensors and/or switches configured to sense and/or detect one or more conditions of the ice making unit. The controller may detect, via one or more sensors and/or switches, and reset all loading (such as for motors and press) based on a connection status for microswitches associated with the water drawer and infrared sensor status (e.g., to determine if the ice is stuck or not).
3. In standby mode, the controller may turn off all loading and the power button light will flash (0.5 s on, 0.5 s off), and all other lights will be turned off.

Ice-Making Mode—In Some Implementations:

1. A user presses the ice making button for one time causing the unit to enter the ice-making mode. At this moment, the ice making button will keep turning on and the buzzer will beep for one time.
2. After entering the ice-making mode, the bullet ice synchronous motor moves to the ice making position, and the water pump begins to pump water for 20 seconds, responsive to control by the controller. At this moment, the controller activates the press and fan that start running, and the ice making time is automatically set according to the ambient temperature (e.g., first round+1 minutes) to start ice making. At the same time, the controller starts the shaved and compressing motors for one round to judge whether there is residual bullet ice in the hopper. If there is bullet ice in the hopper, the controller keeps the shaved and compressing motors working until there is no bullet ice, and otherwise stops waiting for next cycle of new bullet ice to be made.
3. After the completion of the bullet ice making and/or formation and responsive to control by the controller, the bullet ice synchronous motor moves to an ice dropping position. Then the hot air valve opens for ice drop, and the push plate pushes ice into the hopper before the next round and/or cycle of bullet ice making. Below is an exemplary situation of bullet ice making:
   ① When the hopper is not full, the controller continues normal operations and ice is pushed into the hopper.
   ② If the hopper is full of ice at this time, but the ice bin is not full of ice, the unit only drops the ice without pushing it into hopper, and stops ice making for two minutes. If the hopper is still full of ice after two minutes, the controller determines that ice is stuck and enters the stuck ice state program. If the controller detects that the hopper is not full after two minutes, the controller continues the normal deicing and ice making
   ③ In any state, if the ice bin is full of ice, and the bullet ice completes one round of normal operation before ending ice-making mode and entering ice full mode. This round of ice only removes ice and does not push bullet ice into the hopper.
4. Each time the controller via the bullet ice infrared sensor detects that a new bullet ice is pushed into the hopper, if the shaved and compressing system is in the stop state, the controller will activate the shaved and compressing system to work. If the unit is in the working state, it will continue making ice and push the ice to the hopper.
5. If a user presses the power button during the working process, the fan and water pump will stop working, the solenoid valve will start working, and after 1 minute, the solenoid valve and press will stop working, and then the unit will enter standby mode, as controlled by the controller.
6. When the controller of the unit detects a water shortage, the controller and/or unit enters an add water mode:
   ① The adding water light will be on, and the buzzer will beep for one time as controlled by the controller.
   ② After manually adding water, the user presses the power button one time to resume the ice-making mode.
   ③ The unit, via the controller, will automatically detect and resume ice-making mode every 20 minutes. If there is still no water after 18 consecutive attempts, the unit will enter standby mode.
7. If the unit is determined to be full of nugget ice by the controller, it will enter into an ice full state:
   ① Ice full light always on, buzzer will beep for one time.

② The buzzer sounds three times, the press and water pump stop working, and the fan stops working after a delay of 1 minute;

③ The unit will check the ice full status for every 10 minutes, or during a shorter or longer period, to see if the ice is still full. If the ice is full, continue detect for 10 minutes. If the ice is not full, resume the ice-making mode.

Cleaning Mode (in Different Status)—In Some Implementations:

1. After plugging-in the unit, a user presses and holds the "Clean" button for 3 seconds, the buzzer will sound once, the cleaning light will flash (0.5 s on, 0.5 s off), and the unit will enter the "Clean Mode."
2. If the user presses and holds the "Clean" button for 3 seconds during ice-making mode, the unit will stop the current load and enter the "Clean Mode";
3. In "cleaning mode", the cleaning indicator light flashes, and the water pump is kept on for 60 seconds for one round, lasting for 5 rounds responsive to control by the controller. After that, the unit enters standby mode.
4. In "cleaning mode", when a user presses and holds the "cleaning" button for 3 seconds, the buzzer will sound once, the cleaning light will turn off, and the unit will exit "cleaning mode" and enter standby mode.

Scheduling:

A. In one implementation, after the unit has completed 3000 times of ice deicing, and the cleaning light is constantly on, prompting for cleaning request;

B. In one implementation, every 3 months of operation, the cleaning light remains on and prompts for cleaning request;

In some implementations, after completing the cleaning function, the cleaning light will turn off and the memory data of conditions A and B above will be reset at the same time;

Unit Self-Protection Function—In Various Implementations

Various implementations of unit self-protection may be controlled by a controller that senses one or more conditions such as temperature and/or the position of one or more switches and, in response, controls operations of the ice making unit.

1. Ambient Temperature Protection:

If the ambient temperature is less than 9° C. or higher than 44° C., the unit will not work when the power button is pressed, the buzzer will beep for three times, and the power light will remain flashing. During the working process, if the ambient temperature exceeds the temperature limit, and the buzzer sounds three times. After the ice maker completes the last round of ice making, the compressor, fan, and water pump stop working, and the power light keep flashing;

2. Microswitch Protection:

a. In standby mode, the two limit microswitches of the same motor are both in the open/closed state, and the buzzer beep for three times. At this moment, the unit cannot be started for any operation.

b. During the working process, the two limit microswitches of the same motor are both in the open/closed state. After the last set of ice making is completed in manual and automatic modes, the buzzer sounds three times, the compressor and water pump stop working, and the fan is delayed for 1 minute to turn off;

3. Water Drawer and Ice Bin Missing Protection:

In ice-making mode, if the water drawer and ice bin are removed from the unit for more than 5 minutes (or another period of time), the ice making unit and/or machine enters standby mode.

References herein to the positions of elements (e.g., "top," "bottom," "above," "below") are merely used to describe the orientation of various elements in the FIGURES. The orientation of various elements can differ according to other illustrative implementations, and that such variations are intended to be encompassed by the present disclosure. References herein to the order of elements (e.g., "first," "second," "third," "fourth," "fifth," "sixth," "seventh") are merely used for ease of description relative to each element in the FIGURES.

While operations are depicted in the drawings in a particular order, such operations are not required to be performed in the particular order shown or in sequential order, and all illustrated operations are not required to be performed. Actions described herein can be performed in a different order.

Having now described some illustrative implementations, it is apparent that the foregoing is illustrative and not limiting, having been presented by way of example. In particular, although many of the examples presented herein involve specific combinations of method acts or system elements, those acts, and those elements can be combined in other ways to accomplish the same objectives. Acts, elements and features discussed in connection with one implementation are not intended to be excluded from a similar role in other implementations.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations or elements or acts of the systems and methods herein referred to in the singular can also embrace implementations including a plurality of these elements, and any references in plural to any implementation or element or act herein can also embrace implementations including only a single element. References in the singular or plural form are not intended to limit the presently disclosed systems or methods, their components, acts, or elements to single or plural configurations. References to any act or element being based on any information, act or element can include implementations where the act or element is based at least in part on any information, act, or element.

Any implementation disclosed herein can be combined with any other implementation or embodiment, and references to "an implementation," "some implementations," "one implementation" or the like are not necessarily mutually exclusive and are intended to indicate that a particular feature, structure, or characteristic described in connection with the implementation may be included in at least one implementation or embodiment. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements. Modifications of described elements and acts such as variations in sizes, dimensions, structures, shapes and proportions of the various elements, values of parameters, mounting arrangements, use of materials, colors, orientations can occur without materially departing from the teachings and advantages of the subject matter disclosed herein. For example, elements shown as integrally formed can be constructed of multiple parts or elements, the position of elements can be reversed or otherwise varied, and the nature or number of discrete elements or positions can be altered or varied. Other substitutions, modifications, changes and omissions can also be made in the design, operating conditions and arrangement of the disclosed elements and operations without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor.

When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Systems and methods described herein may be embodied in other specific forms without departing from the characteristics thereof. Further relative parallel, perpendicular, vertical or other positioning or orientation descriptions include variations within +/−10% or +/−10 degrees of pure vertical, parallel or perpendicular positioning. References to "approximately," "about" "substantially" or other terms of degree include variations of +/−10% from the given measurement, unit, or range unless explicitly indicated otherwise. Coupled elements can be electrically, mechanically, or physically coupled with one another directly or with intervening elements. Scope of the systems and methods described herein is thus indicated by the appended claims, rather than the foregoing description, and changes that come within the meaning and range of equivalency of the claims are embraced therein.

What is claimed is:

1. An ice maker, comprising:

a processor to receive ice of a first size and process the ice to output ice of a second size less than the first size;

one or more chambers to receive the ice of the second size;

a press coupled with the processor; and a motor to drive the press towards the one or more chambers to compress the ice of the second size in the one or more chambers into output ice.

2. The ice maker of claim 1, wherein the processor comprises a hopper coupled with one or more blades to cut the ice of the first size into the ice of the second size.

3. The ice maker of claim 1, wherein the one or more chambers extend longitudinally along a corresponding one or more axes, and the motor is to drive the press in a direction parallel with the one or more axes.

4. The ice maker of claim 1, wherein the press comprises a plate coupled with one or more pins, and the ice maker comprises one or more gears coupled with one or more leadscrews, the one or more leadscrews having a threaded coupling with the plate.

5. The ice maker of claim 1, wherein the ice maker is a standalone ice making appliance, and the ice of the first size is received from a device remote from the ice maker.

6. The ice maker of claim 1, wherein the one or more chambers are structured to form the output ice to satisfy one or more criteria regarding at least one of a volume, a mass, a number of layers, a ratio of ice to air, or a shape of the output ice.

7. The ice maker of claim 1, wherein an auger comprises a first portion comprising the processor and a second portion comprising the press.

8. The ice maker of claim 1, wherein the ice of the second size comprises a flake of ice smaller than the output ice.

9. The ice maker of claim 1, wherein the press is to move in a direction of parallel with a direction of movement of the ice of the first size through the processor.

10. The ice maker of claim 1, wherein the press is to compress the ice of the second size in a direction perpendicular to a direction of movement of the ice of the first size through the processor.

11. The ice maker of claim 1, wherein the one or more chambers comprise one or more channels for output of the output ice on an opposite side of the one or more channels from the press.

12. An ice making appliance, comprising:

a receiver to receive preformed ice;

a processor to process the preformed ice into ice flakes;

a mold defining an opening facing the receiver to receive the ice flakes from the receiver; and a ram to apply a force against the ice flakes in the mold into output ice to satisfy one or more criteria regarding at least one of a volume, a mass, a number of layers, a ratio of ice to air, or a shape of the output ice.

13. The ice making appliance of claim 12, wherein the processor comprises one or more blades to cut the preformed ice into the ice flakes.

14. The ice making appliance of claim 12, further comprising a motor and one or more gears coupled with the ram to cause the ram to move from a first position at least partially outside of the mold to a second position further inside the mold than the first position to apply the force against the ice flakes in mold.

15. The ice making appliance of claim 12, wherein the ram is to be operated responsive to at least one of a schedule, an input, or detection of reception of the preformed ice.

16. The ice making appliance of claim 12, wherein the receiver extends along a first axis perpendicular to a second axis along which the ram is to be moved.

17. The ice making appliance of claim 12, further comprising a pair of leadscrews coupled with the ram, the pair of leadscrews to be rotated in opposite directions to cause movement of the ram towards the mold.

18. A method of ice making, comprising:

receiving preformed ice in a receiver;

processing the preformed ice into ice flakes having a smaller size than the preformed ice;

receiving the ice flakes in one or more molds;

compressing the ice flakes in the one or more molds into output ice; and dispensing the output ice from the one or more molds.

19. The method of claim 18, wherein compressing the ice flakes comprises driving a plurality of pins against the ice flakes.

* * * * *